United States Patent [19]

Kobayashi et al.

[11] 4,343,335

[45] Aug. 10, 1982

[54] PROCESS AND APPARATUS FOR MANUFACTURING SOAP PADS

[75] Inventors: Hisao Kobayashi, Chiba; Kazuo Fujita, Wakayama, both of Japan

[73] Assignee: Kao Soap Company, Ltd., Tokyo, Japan

[21] Appl. No.: 134,689

[22] Filed: Mar. 27, 1980

[51] Int. Cl.[3] ..... B21F 3/00

[52] U.S. Cl. ..... 140/71 C; 29/4.5 B

[58] Field of Search ..... 140/71 C; 29/4.5 B; 252/91, 123, 128

[56] References Cited

U.S. PATENT DOCUMENTS 3,562,061 2/1971 Maidment ..... 140/71 C X

*Primary Examiner*—Mark Rosenbaum
*Assistant Examiner*—Timothy V. Eley
*Attorney, Agent, or Firm*—Birch, Stewart, Kolasch & Birch

[57] ABSTRACT

A method and apparatus for manufacturing a soap pad comprising winding metallic wool into a roll form, applying a soap solution internally to the roll form to cause the solution to adhere to the metallic wool, separating the metallic wool roll from the spindle and press forming the metallic wool into a desired shape.

10 Claims, 4 Drawing Figures

PROCESS AND APPARATUS FOR MANUFACTURING SOAP PADS

BACKGROUND AND SUMMARY OF THE INVENTION

The present invention relates to a method and apparatus for manufacturing a soap pad by applying soap to metallic wool and forming it into a desired shape. More particularly, the present invention is directed to winding steel wool on a spindle, applying a soap solution so as to cause it to adhere to the steel wool, and press forming the soap coated steel wool into a desired shape.

Soap pads, which are sometimes referred to as scouring pads, conventionally consist of a mass of steel wool and soap coated thereon and are used in the cleaning of pots and pans containing hard-to-remove solid materials or grease, and have usually been manufactured by forming steel wool into a roll, dipping the roll in a soap solution or inserting a soap solution injection nozzle into the roll to apply the soap solution and then press forming the roll into a desired shape. These types of processes have not been found desirable for industrial mass production due to the time consuming nature of the processes as a result of the multihandling.

Accordingly, it is an object of the present invention to provide a method for manufacturing a soap pad suitable for industrial mass production which will overcome the above noted disadvantages.

It is a further object of the present invention to provide a process for manufacturing a soap pad suitable for industrial mass production, employing fewer steps than conventional processes.

Yet, still a further object of the present invention is to provide an apparatus for formulating soap pads out of steel wool which incorporates the soap coating step congruent with the winding step.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the above objects and others are accomplished in accordance with the present invention by employing a process comprising the steps of (1) winding a metallic wool such as steel wool into a roll form on a spindle, (2) applying a soap solution through at least one hole in said spindle to cause said solution to adhere to said steel wool, (3) separating said steel wool from the spindle, and (4) press forming said steel wool into a desired shape.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
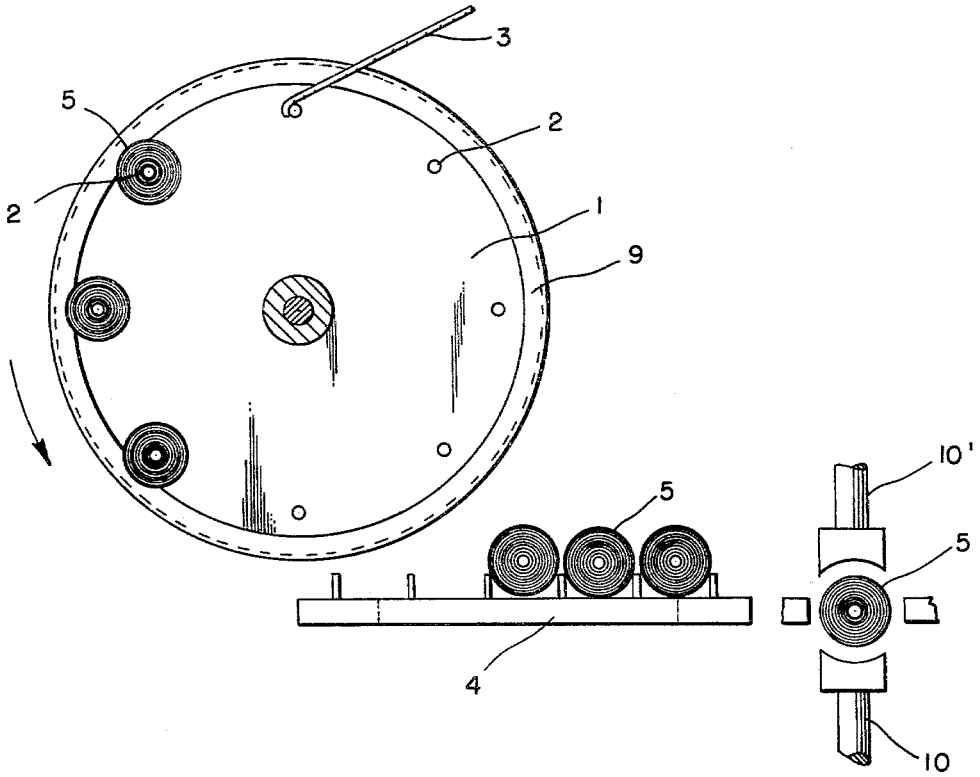
FIG. 1 is a front elevation view of the apparatus for practicing the process of the present invention.
Figure 2:
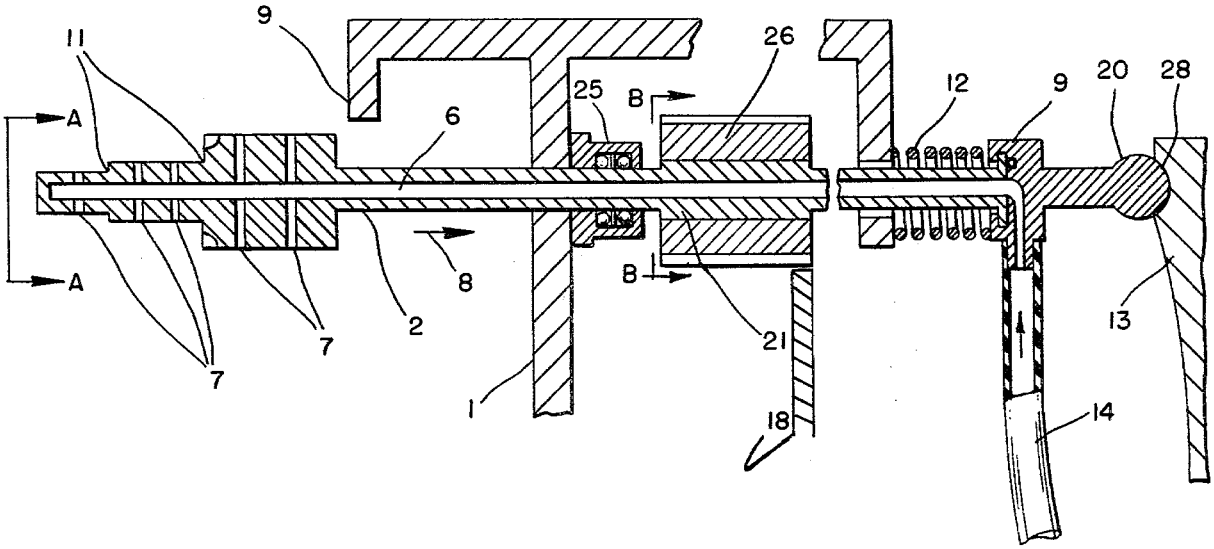
FIG. 2 is an enlarged, cross-sectional view of a spindle and its associated elements in its pre-winding condition.

A preferred embodiment of the present invention is described with reference to the drawings, wherein FIG. 1 illustrates a plurality of spindles 2 provided at predetermined intervals on a rotary disk 1. A mass of steel wool 3 is supplied at a predetermined position and wound in roll form 5 on each spindle 2 when the latter reaches the beforementioned site. A stop plate 9 forms a part of the rotary disk 1 which functions to remove the coated steel wound roll 5 in a manner as is further discussed below. The disk 1 rotates in the direction indicated. Each spindle 2 has an axial hole 6 and a plurality of holes 7 extending radially outwardly from the axial hole 6 as shown, for example, in FIG. 2. A soap solution is supplied through the holes or channels 6 and 7 to adhere to the inner surface of the steel wool roll 5. After the soap solution has been applied to the wound steel wool 5 in roll form, the spindle 2 is moved in the direction of arrow 8 and gradually withdrawn from the steel wool roll 5 with the assistance of stop plate 9 which operates in concert with the opening biasing device 12. Thus, the steel wool roll 5 is released from the spindle 2 and falls on a conveyor 4 and is carried into a forming press 10—10', and the steel wool roll 5 is pressed into a desired shape in a conventional manner.

Figure 3:
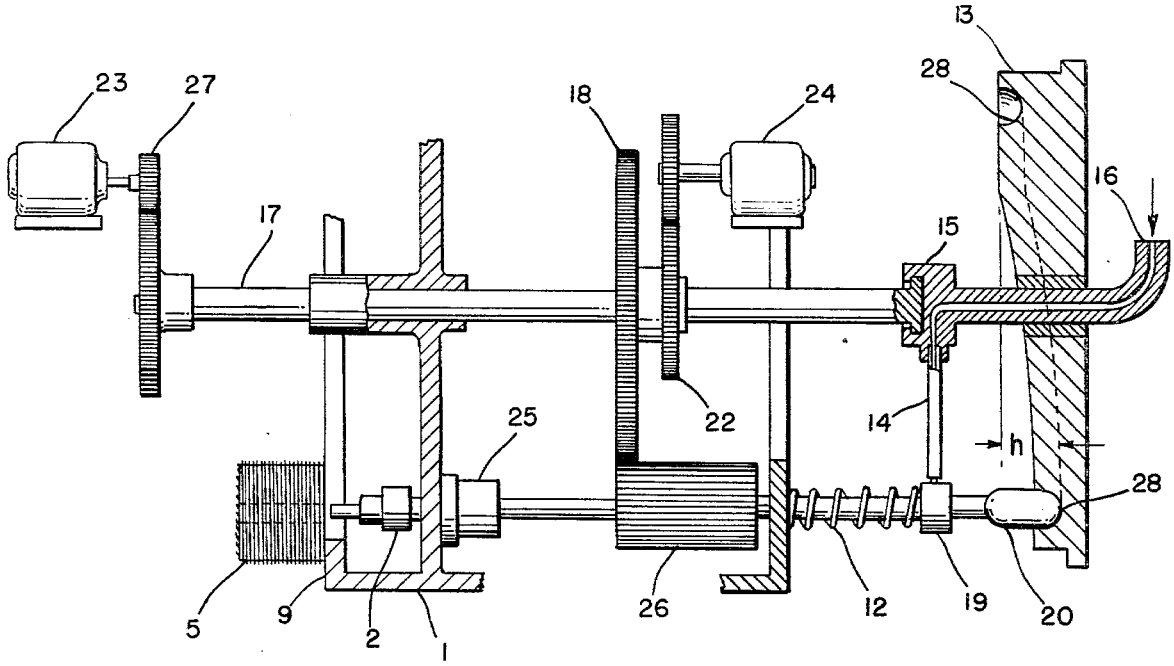
FIG. 3 is an enlarged, cross-sectional view of a shaft and its associated elements with the spindle represented at a time in the process when the impregnated steel wound roll is released therefrom.

In FIG. 3 there is seen a rotary disk 1 positioned about a shaft 17, and the disk is rotated by a motor 23 via drive means 27. Each spindle 2 is fitted to the rotary disk with a bearing box 25 so as to be rotatable and horizontally slidable. A gear 18 is rotated by a motor 24 via gear 22 independently of the shaft 17, engaging gear 26 and causing spindle 2 to rotate. At the right end of the spindle 2, a rotary joint 19 and a cam follower 20 are provided. The cam follower 20 is held to a cam 13 with the cam groove 28 with a spring biasing device 12. The soap solution is supplied into an inlet 16 as indicated and passes through a rotary joint 15, a flexible pipe 14, rotary joint 19 into the axial channel 6 and is injected from radial holes 7 onto the wound steel wool roll 5. When the cam 13 sinks by a distance h in accordance with the rotation of the disk 1, the wound steel wool roll 5 is released or ejected from the spindle 2 by the stop plate 9.

Figure 4:
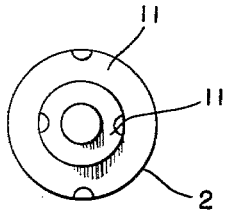
FIG. 4 is a frontal view of a spindle observed from the direction of arrows A in FIG. 2.

As demonstrated in FIG. 4, each spindle 2 has a stepped configuration defining a plurality of recessed shoulders 11 which facilitate the winding of steel wool on the spindle and its withdrawal from the spindle.

Any metallic wool which is suitable for manufacturing a soap pad may be used in the present invention. Preferred is steel wool, for example, having a diameter of about 1 to 500$\mu$, preferably about 10 to 70$\mu$. The cross-sectional shape of the steel wool used in the present invention is not critical, and thus steel wool having a triangular, square, circular or flat cross-section can be used in the present invention.

Figure 5:
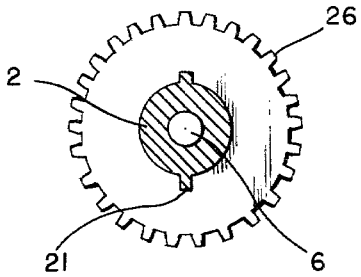
FIG. 5 is a cross-sectional view taken along B—B of FIG. 2.

In FIG. 5 there is seen a cross section of a spindle 2 with spline 21 and axial hole or channel 6. The gear or toothed wheel 26 is fabricated so as to turn the spindle 2 during the course of the process.

The soap solution to be applied to the steel wool in the present invention includes an aqueous solution of a soap and a mixture of a soap and other surfactants compatible with the soap. These solutions are well known in the art and disclosed, for example, in U.S. Pat. Nos. 3,585,144, 2,896,242 and 3,337,465.

According to the present invention, the spindles serve both to collect the steel wool thereon and to distribute a soap solution through their channels 6 and 7. This arrangement makes it possible to accomplish the formation of steel wool into a roll shape and the efficient application of a soap solution thereto in substantially one continuous operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for manufacturing a soap pad comprising the steps of: winding metallic wool into a roll form onto a spindle containing at least one hole therein;

applying a soap solution to said roll form through said hole of said spindle to cause said solution to adhere to said metallic wool;

separating said metallic wool from said spindle; and press forming said metallic wool into a desired shape.

2. The method for manufacturing a soap pad of claim 1, wherein the metallic wool is steel wool.

3. The method of claim 1, wherein the hole comprises an axially disposed channel within the spindle, and at least one radially disposed channel, said radial channel connecting with said axial channel for distributing the soap solution to said steel wool.

4. A continuous method for manufacturing soap pads utilizing a disk-like member containing a plurality of spindles which extend from the surface of said disk-like member, said spindles containing means for dispersing a soap solution, which comprises, sequentially winding metallic wool into a roll on said spindles;

applying a soap solution internally to said roll of metallic wool, causing said solution to adhere to said metallic wool;

gradually retracting the spindle from the center of the roll of metallic wool, thereby separating said metallic wool from the spindle; and press forming said metallic wool rolls into a desired shape.

5. An apparatus for manufacturing soap pads which comprises, a disk-like member and means for rotating said disk-like member;

a plurality of spindle elements extending from said disk-like member defining a plurality of metallic wool-receiving stations;

means for sequentially winding metallic wool into a roll onto each of said spindle elements;

a means for dispersing a soap solution from said spindle elements;

means for gradually separating said roll of metallic wool from the spindle elements; and means for press forming said metallic wool into soap pads having a desired shape.

6. The apparatus of claim 5, wherein the separating means comprises a biasing means for retracting said spindle elements from the surface of the disk-like member, thereby releasing the roll of metallic wool from the wool receiving station.

7. The apparatus of claim 6, wherein said separating means further includes a stop plate member working in concert with said biasing means.

8. The apparatus of claim 6, further including a conveyor means provided for transferring the rolls of metallic wool from the disk-like member to said press forming means.

9. The apparatus of claim 6, wherein said biasing means comprises a spring member working in combination with a cam member.

10. The apparatus of claim 5, wherein the means for dispersing a soap solution from said spindle elements comprises an axially disposed channel provided in said spindle elements, and at least one radially disposed channel communicating with said axial channel and means for introducing the soap solution to said axial channel.

* * * * *